US010736359B2

(12) United States Patent
Verleur et al.

(10) Patent No.: US 10,736,359 B2
(45) Date of Patent: Aug. 11, 2020

(54) CARTRIDGE-BASED VAPORIZERS

(71) Applicant: VMR Products LLC, Miami, FL (US)

(72) Inventors: Jan Andries Verleur, Miami Beach, FL (US); Dan Recio, Miami Beach, FL (US); Zhiyuan Liu, Miami, FL (US); Hans Verleur, El Dorado, CA (US)

(73) Assignee: VMR Products, LLC, San Francisco, CA (US)

( * ) Notice: Subject to any disclaimer, the term of this patent is extended or adjusted under 35 U.S.C. 154(b) by 97 days.

(21) Appl. No.: 15/829,476

(22) Filed: Dec. 1, 2017

(65) Prior Publication Data

US 2018/0153219 A1 Jun. 7, 2018

Related U.S. Application Data

(60) Provisional application No. 62/465,455, filed on Mar. 1, 2017, provisional application No. 62/429,365, filed on Dec. 2, 2016.

(51) Int. Cl.

| | |
|---|---|
| ***A24F 13/00*** | (2006.01) |
| ***A24F 47/00*** | (2020.01) |
| ***H05B 3/44*** | (2006.01) |

(52) U.S. Cl.

CPC ..... *A24F 47/008* (2013.01); *H05B 3/44* (2013.01); *H05B 2203/021* (2013.01); *H05B 2203/035* (2013.01)

(58) Field of Classification Search

CPC ..... A24F 47/00
USPC ..... 131/328–329
See application file for complete search history.

(56) References Cited

U.S. PATENT DOCUMENTS

| | | | |
|---|---|---|---|
| 6,412,494 | B1 | 7/2002 | Bloom, Jr. |
| 6,516,796 | B1 | 2/2003 | Cox et al. |
| 6,889,687 | B1 | 5/2005 | Olsson |
| 7,913,686 | B2 | 3/2011 | Hughes et al. |
| 8,550,069 | B2 | 10/2013 | Alelov |
| 8,689,789 | B2 | 4/2014 | Andrus et al. |
| 9,066,543 | B2 | 6/2015 | Cameron |
| 9,078,473 | B2 | 7/2015 | Worm et al. |
| 9,089,166 | B1 | 7/2015 | Scatterday |
| 9,132,248 | B2 | 9/2015 | Qiu |
| 9,167,849 | B2 | 10/2015 | Adamic |
| 9,247,773 | B2 | 2/2016 | Memari et al. |
| 9,302,825 | B2 | 4/2016 | Liu |
| 9,498,002 | B1 | 11/2016 | Soreide |

(Continued)

FOREIGN PATENT DOCUMENTS

| | | | |
|---|---|---|---|
| CA | 2646756 | C | 10/2010 |
| CN | 101951796 | A | 1/2011 |

(Continued)

*Primary Examiner* — Phuong K Dinh

(74) *Attorney, Agent, or Firm* — Mintz Levin Cohn Ferris Glovsky and Popeo, P.C.

(57) ABSTRACT

A cartridge-based vaporizer is disclosed. The vaporizer has a body with a control panel and a chamber for receiving a cartridge. A cartridge including a vaporizable product container and an atomizer may be placed in the chamber and selectively secured within the chamber. The body may include a variable air intake in fluid communication with the atomizer when the atomizer is received in chamber. The body may include a cartridge identification sensor configured to identify a cartridge type of the cartridge based on a cartridge identifier of the cartridge.

12 Claims, 8 Drawing Sheets

(56) References Cited

U.S. PATENT DOCUMENTS

| | | | | |
|---|---|---|---|---|
| 9,504,278 | B2 | 11/2016 | Liu | |
| 9,668,522 | B2 | 6/2017 | Memari et al. | |
| 9,913,493 | B2 | 3/2018 | Worm et al. | |
| 9,930,915 | B2 | 4/2018 | Worm et al. | |
| 9,936,733 | B2 | 4/2018 | Ampolini et al. | |
| 9,974,743 | B2 | 5/2018 | Rose et al. | |
| 10,058,122 | B2 | 8/2018 | Steingraber et al. | |
| 10,143,237 | B2 | 12/2018 | Watson | |
| 10,362,809 | B2 | 7/2019 | Worm et al. | |
| 2001/0032643 | A1 | 10/2001 | Hochrainer et al. | |
| 2003/0005926 | A1 | 1/2003 | Jones et al. | |
| 2005/0022806 | A1 | 2/2005 | Beaumont et al. | |
| 2007/0045288 | A1 | 3/2007 | Nelson | |
| 2007/0119450 | A1 | 5/2007 | Wharton et al. | |
| 2007/0125765 | A1 | 6/2007 | Nelson | |
| 2008/0241255 | A1 | 10/2008 | Rose et al. | |
| 2011/0297166 | A1 | 12/2011 | Takeuchi et al. | |
| 2012/0318882 | A1 | 12/2012 | Abehasera | |
| 2014/0144429 | A1 | 5/2014 | Wensley et al. | |
| 2014/0190496 | A1 | 7/2014 | Wensley et al. | |
| 2014/0238422 | A1 | 8/2014 | Plunkett et al. | |
| 2014/0238424 | A1 | 8/2014 | Macko et al. | |
| 2014/0261493 | A1 | 9/2014 | Smith et al. | |
| 2014/0353856 | A1* | 12/2014 | Dubief | B01F 3/04078 261/128 |
| 2014/0366898 | A1 | 12/2014 | Monsees et al. | |
| 2015/0007836 | A1 | 1/2015 | Li et al. | |
| 2015/0101625 | A1* | 4/2015 | Newton | H05B 1/0244 131/329 |
| 2015/0164146 | A1 | 6/2015 | Li et al. | |
| 2015/0173417 | A1 | 6/2015 | Gennrich et al. | |
| 2015/0216234 | A1 | 8/2015 | Chung | |
| 2015/0216237 | A1 | 8/2015 | Wensley et al. | |
| 2015/0245654 | A1 | 9/2015 | Memari et al. | |
| 2015/0245655 | A1 | 9/2015 | Memari et al. | |
| 2015/0245657 | A1 | 9/2015 | Memari et al. | |
| 2015/0245665 | A1 | 9/2015 | Memari et al. | |
| 2015/0245666 | A1 | 9/2015 | Memari et al. | |
| 2015/0245667 | A1 | 9/2015 | Memari et al. | |
| 2015/0245668 | A1 | 9/2015 | Memari et al. | |
| 2015/0257451 | A1 | 9/2015 | Brannon et al. | |
| 2015/0289567 | A1 | 10/2015 | Liu | |
| 2016/0099592 | A1 | 4/2016 | Gatta et al. | |
| 2016/0150824 | A1 | 6/2016 | Memari et al. | |
| 2016/0198769 | A1 | 7/2016 | Liu | |
| 2016/0213062 | A1 | 7/2016 | Doyle | |
| 2016/0213065 | A1 | 7/2016 | Wensley et al. | |
| 2016/0219936 | A1 | 8/2016 | Alarcon | |
| 2016/0227837 | A1 | 8/2016 | Hammel et al. | |
| 2016/0309789 | A1 | 10/2016 | Thomas, Jr. | |
| 2016/0321879 | A1 | 11/2016 | Oh et al. | |
| 2017/0071260 | A1 | 3/2017 | Li et al. | |
| 2017/0079324 | A1 | 3/2017 | Eksouzian | |
| 2017/0099877 | A1 | 4/2017 | Worm et al. | |
| 2017/0156408 | A1 | 6/2017 | Li et al. | |
| 2017/0196264 | A1 | 7/2017 | Liu | |
| 2017/0215479 | A1 | 8/2017 | Kies | |
| 2017/0231282 | A1 | 8/2017 | Bowen et al. | |
| 2017/0246405 | A1 | 8/2017 | Wensley et al. | |
| 2017/0251718 | A1 | 9/2017 | Armoush et al. | |
| 2017/0347709 | A1 | 12/2017 | Laakso et al. | |
| 2018/0027880 | A1 | 2/2018 | Dong et al. | |
| 2018/0035718 | A1 | 2/2018 | Liu | |
| 2018/0153219 | A1 | 6/2018 | Verleur et al. | |
| 2018/0154092 | A1 | 6/2018 | Patoret | |
| 2018/0160737 | A1 | 6/2018 | Verleur et al. | |
| 2018/0177234 | A1 | 6/2018 | Lee | |

FOREIGN PATENT DOCUMENTS

| | | | |
|---|---|---|---|
| CN | 204132390 | U | 2/2015 |
| CN | 205358227 | U | 7/2016 |
| CN | 205409676 | U | 8/2016 |
| EP | 3031338 | A1 | 6/2016 |
| EP | 3031339 | A1 | 6/2016 |
| EP | 3143882 | A2 | 3/2017 |
| EP | 3229619 | B1 | 10/2017 |
| EP | 3047742 | B1 | 3/2018 |
| EP | 2982255 | B1 | 5/2019 |
| EP | 3085251 | B1 | 9/2019 |
| GB | 2412876 | A | 10/2005 |
| GB | 2533174 | A | 6/2016 |
| JP | 2009213428 | A | 9/2009 |
| KR | 200464538000 | Y1 | 1/2013 |
| KR | 101530764 | B1 | 6/2015 |
| WO | WO-02098390 | A2 | 12/2002 |
| WO | WO-2012164033 | A1 | 12/2012 |
| WO | WO-2013083636 | A1 | 6/2013 |
| WO | WO-2014067236 | A1 | 5/2014 |
| WO | WO-2014117382 | A1 | 8/2014 |
| WO | WO-2014195687 | A1 | 12/2014 |
| WO | WO-2015010242 | A1 | 1/2015 |
| WO | WO-2015021651 | A1 | 2/2015 |
| WO | WO-2015027436 | A1 | 3/2015 |
| WO | WO-2015157893 | A1 | 10/2015 |
| WO | WO-2015168912 | A1 | 11/2015 |
| WO | WO-2015172361 | A1 | 11/2015 |
| WO | WO-2015180027 | A1 | 12/2015 |
| WO | WO-2015180061 | A1 | 12/2015 |
| WO | WO-2015180071 | A1 | 12/2015 |
| WO | WO-2015192336 | A1 | 12/2015 |
| WO | WO-2015192337 | A1 | 12/2015 |
| WO | WO-2015193456 | A1 | 12/2015 |
| WO | WO-2016000232 | A1 | 1/2016 |
| WO | WO-2016000233 | A1 | 1/2016 |
| WO | WO-2016023177 | A1 | 2/2016 |
| WO | WO-2016026105 | A1 | 2/2016 |
| WO | WO-2016029344 | A1 | 3/2016 |
| WO | WO-2016112534 | A1 | 7/2016 |
| WO | WO-2016127390 | A1 | 8/2016 |
| WO | WO-2016155316 | A1 | 10/2016 |
| WO | WO-2016169669 | A1 | 10/2016 |
| WO | WO-2016169797 | A1 | 10/2016 |
| WO | WO-2016178098 | A2 | 11/2016 |
| WO | WO-2016187943 | A1 | 12/2016 |
| WO | WO-2016193705 | A2 | 12/2016 |
| WO | WO-2016200255 | A1 | 12/2016 |
| WO | WO-2016201602 | A1 | 12/2016 |
| WO | WO-2016202033 | A1 | 12/2016 |
| WO | WO-2017007252 | A1 | 1/2017 |
| WO | WO-2017011419 | A1 | 1/2017 |
| WO | WO-2017023589 | A1 | 2/2017 |
| WO | WO-2017049653 | A1 | 3/2017 |
| WO | WO-2017054424 | A1 | 4/2017 |
| WO | WO-2017064323 | A1 | 4/2017 |
| WO | WO-2017064324 | A1 | 4/2017 |
| WO | WO-2017075753 | A1 | 5/2017 |
| WO | WO-2017143494 | A1 | 8/2017 |
| WO | WO-2017143495 | A1 | 8/2017 |

* cited by examiner

CARTRIDGE-BASED VAPORIZERS

CROSS REFERENCE TO RELATED APPLICATIONS

This application claims the benefit of U.S. Provisional Application Ser. No. 62/429,365, filed Dec. 2, 2016 and U.S. Provisional Application Ser. No. 62/465,455, filed Mar. 1, 2017, the disclosures of each of which are hereby incorporated herein by reference in their entireties.

BACKGROUND

1. Technical Field

This disclosure relates generally to vaporizers, which may also be referred to as electronic cigarettes.

2. Background Information

Vaporizers have recently emerged as a new product for providing nicotine and other products through a smokeless inhalation process. There are many embodiments of vaporizers including the electronic cigarette. In general, implementations consist of a power supply (typically a battery) and an atomizing device. In reusable electronic cigarettes, the two items are separated into a battery and a cartomizer, to allow the disposal and replacement of the nicotine containing fluid cartomizer while preserving for additional use the more costly battery and associated circuitry (microcontroller, switch, indicating light emitting diode (LED), etc.). In disposable electronic cigarettes the two functions are integrated into one unit that is disposed of after exhaustion of either the battery energy or the vaporizable fluid ("E-liquid"), typically nicotine-containing, that is associated with the cartomizer.

The E-liquid that is used to produce vapor in electronic cigarettes is typically a flavor concentrate, optionally with a variable percentage of a liquid nicotine concentrate, dissolved in a solution of one or more of propylene glycol (PG) and/or vegetable glycerin (VG) and/or polyethylene glycol 400 (PEG400). This liquid is often sold in a bottle or in disposable cartridges or cartomizers. Many different flavors of such E-liquids are sold, including flavors that resemble the taste of regular tobacco, menthol, vanilla, coffee, cola and various fruits. E-liquids containing a wide range of nicotine concentrations, as well as nicotine-free liquids are available in the marketplace.

In addition to E-liquid, other products may be used to produce vapor such as waxes and solids such as loose leafs. Generally, each type of product requires a specific type of atomizer. A loose leaf product may be vaporized by a hot stream of gas, whereas waxes and E-liquids may be vaporized upon contact with a heated element.

BRIEF SUMMARY

In one aspect, a vaporizer is disclosed. The vaporizer includes a body, body housing, a battery and a control panel. The body has a chamber at the upper end for receiving a cartridge. A cartridge sized and shaped to complement the chamber is secured within the chamber. The cartridge has a vaporizable product and an atomizer. An interface for locking and/or unlocking selectively releases the cartridge from the chamber. The interface also may recognize cartridge operation parameters and/or allow for their manual adjustments alone or in combination with a cartridge release button.

In a second aspect, a vaporizer is disclosed. The vaporizer includes a body, the body including a battery, a control panel, and a variable area air intake. The body has an upper end with a chamber. The vaporizer further includes a cartridge sized and shaped to complement the chamber. The cartridge has a vaporizable product container and an atomizer. When the cartridge is received in the chamber, the atomizer is in fluid communication with the variable area air intake. The vaporizer further includes an interface for selectively releasing the cartridge from the chamber.

In a third aspect, a vaporizer is disclosed. The vaporizer includes a body, the body including a battery, a control panel, and a cartridge identification sensor. The body has an upper end with a chamber. The vaporizer further includes a cartridge sized and shaped to complement the chamber. The cartridge has a vaporizable product container, an atomizer, and a cartridge identifier. The vaporizer further includes an interface for selectively releasing the cartridge from the chamber. The cartridge identification sensor is configured to identify a cartridge type based on the cartridge identifier

DETAILED DESCRIPTION

The following detailed description and the appended drawings describe and illustrate some embodiments of the disclosure for the purpose of enabling one of ordinary skill in the relevant art to make and use these embodiments. As such, the detailed description and illustration of these embodiments are purely illustrative in nature and are in no way intended to limit the scope of the disclosure in any manner. It should also be understood that the drawings are not necessarily to scale and in certain instances details may have been omitted, which are not necessary for an understanding of the embodiments, such as details of fabrication and assembly. In the accompanying drawings, like numerals represent like components.

Figure 1:
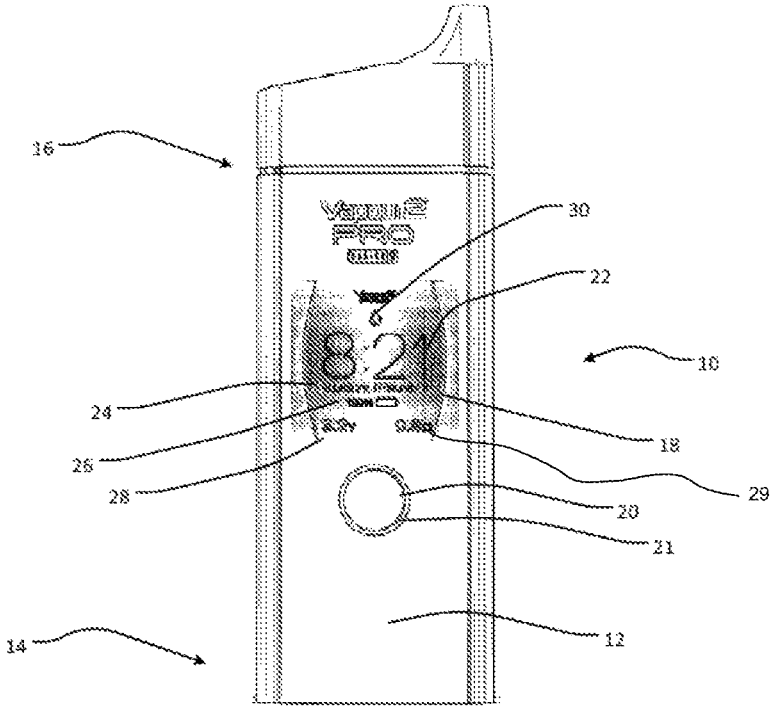
FIG. 1 illustrates an embodiment of a vaporizer.

FIG. 1 illustrates an embodiment of a vaporizer 10. The vaporizer has a body 12 having a lower end 14 and an upper end 16. The body contains a battery unit, which may include a battery 15, see FIG. 7, for powering the vaporizer and necessary circuitry, which may include a circuit board 17, see FIG. 9, for controlling the vaporizer. Upper end 16 has a chamber 19, see FIG. 9, for receiving a cartridge which will be described in reference to FIGS. 4-6. A user interface 18 is located between lower end 14 and upper end 16, and provides an interface for interaction with a user.

User interface 18 may include a liquid crystal display (LCD), a light emitting diode display (LED), or other display as known in the art. The user interface 18 may be touch sensitive for receiving user input. In the embodiment of FIG. 1, user interface 18 includes information such as time 22, date 24, battery level 26, current voltage 28, heat resistance (ohms) 29 and cartridge type 30. Circuit board 17 is coupled to user interface 18 and the battery 15, and is located within body 12. The user interface 18 may connect to the circuit board 17 through a cutout in body 12. While user interface 18 as described in this disclosure embodies an implementation of a control panel, given the benefit of this disclosure those skilled in the art may recognize other implementations of a control panel.

Other user interfaces may be present such as button 20. Button 20 may provide multiple functions. For example, the function may be dependent on the number of times button 20 is pressed, the length of time button 20 is pressed, the pressure used to press button 20, or other characteristics. Button 20 may be a physical button such as a switch, or it may be an electronic button such as a capacitive button. Button 20 is in electrical communication with the circuit board 17 and may connect to the circuit board 17 through a cut out in body 12. Additionally, button 20 may have a glowing ring 21 around it to indicate a status of the vaporizer 10. In some embodiments, glowing ring 21 may have different colors to indicate the device status and/or temperature of a cartridge. In some embodiments, button 20 may serve to lock and unlock the user interface 18. Pressing button 20 a set number of times within a set time period may lock or unlock user interface 18. For instance, pressing button 20 three times within a two second interval may lock or unlock the user interface 18.

Figure 2:
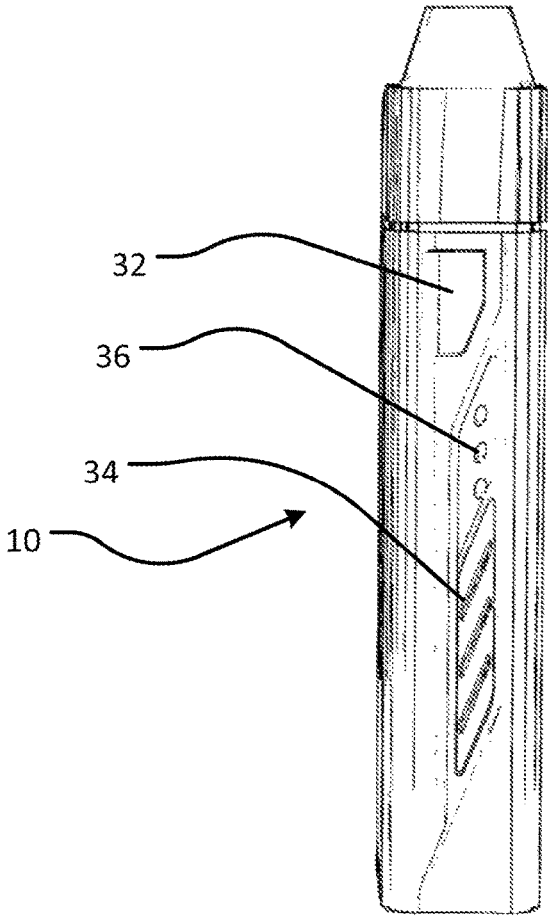
FIG. 2 illustrates a side view of a vaporizer.
Figure 3:
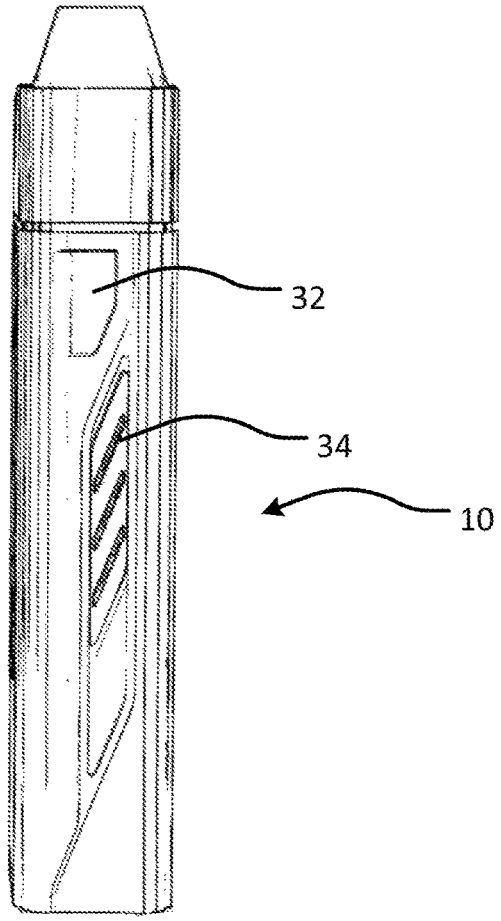
FIG. 3 illustrates a side view of a vaporizer.

FIG. 2 and FIG. 3 illustrate a side view of vaporizer 10. A side button 32 provides a user interface. In some embodiments, pressing side button 32 will activate an atomizer, for example atomizer 33, see FIG. 4, contained in vaporizer 10. The atomizer 33 may be fired for a set duration, or it may fire for the length of time side button 32 is pressed. In some embodiments, pressing side button 32 a set number of times within a set time period may lock or unlock vaporizer 10. For instance, pressing side button 32 three times within a two second interval may lock or unlock the vaporizer 10.

Vaporizer 10 may have a sliding switch 34 for controlling other aspects. For example, in place of the previously described locking feature using side button 32, sliding switch 34 may have a lock position and an unlocked position. The position shown in FIG. 2 may correspond to an unlocked state, while the position shown in FIG. 3 may correspond to a locked state. Additionally, sliding switch 34 may selectively cover and uncover an air intake 36 for the atomizer, for example atomizer 33, and thus provide vaporizer 10 with a variable area air intake. Different types of cartridges and user preferences may dictate the desired air flow through vaporizer 10. The amount of air flow may be adjusted by position of sliding switch 34. In the embodiment of FIG. 2, air intake 36 has three holes. The amount of airflow in the vaporizer 10 will vary depending on the number of holes covered by sliding switch 34. In other embodiments, a continuous air flow adjustment may be possible using a channel in place of holes. The position of sliding switch 34 in FIG. 2 produces maximum air flow, while the position of the sliding switch in FIG. 3 covers air intake 36 resulting in a minimum air flow. While sliding switch 34 and air intake 36 as described in this disclosure embody some implementations of a variable area air intake for a vaporizer, given the benefit of this disclosure those skilled in the art may recognize other implementations of a variable air intake for a vaporizer.

Figure 4:
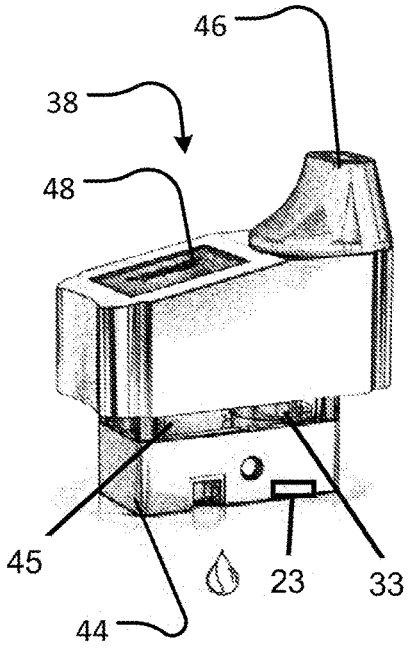
FIG. 4 illustrates an embodiment of a cartridge.
Figure 5:
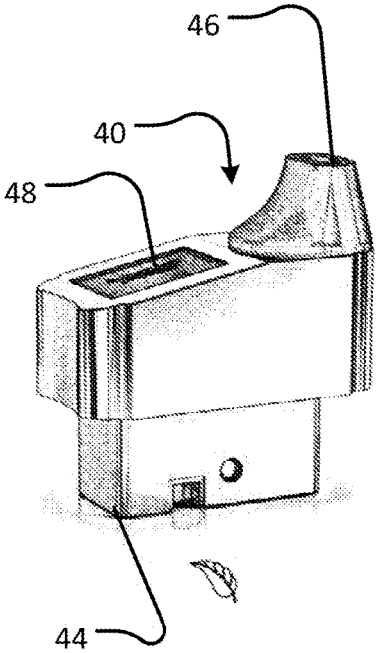
FIG. 5 illustrates an embodiment of a cartridge.
Figure 6:
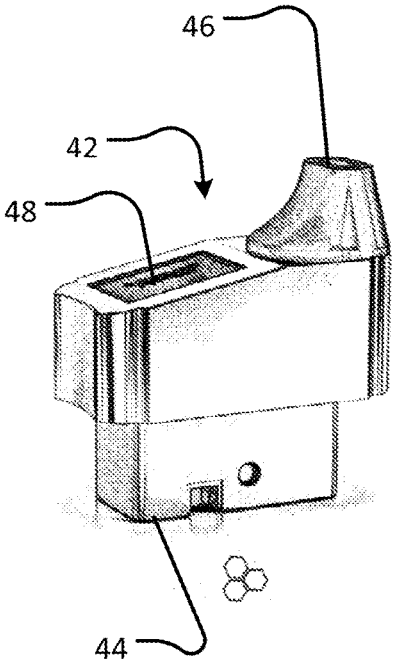
FIG. 6 illustrates an embodiment of a cartridge.

FIG. 4, FIG. 5, and FIG. 6 illustrate an E-liquid cartridge 38, a loose leaf cartridge 40, and a wax cartridge 42, respectively. Each cartridge has a base portion 44 that is sized and shaped to complement the chamber 19 of body 12 of vaporizer 10. Each cartridge contains an atomizer, for example atomizer 33, that is specific to the type of vaporizable product used in the cartridge. The cartridges are interchangeable with one another and each is specific to a type of product. The cartridges are refillable with vaporizable product suitable for the cartridge. For example, a cartridge may include a cartridge container, for example cartridge container 45, which can be filled with vaporizable product suitable for the cartridge. Body 12 supplies power from the battery 15 and each cartridge contains an atomizer, for example atomizer 33, which vaporizes vaporizable product within the cartridge. The vapor mixes with incoming air and exhausts through mouthpiece 46. A window 48 provides a view into the cartridge so that a user may observe the production of vapor.

Each cartridge includes a replaceable heating element and serviceable atomizer, for example atomizer 33. Because the cartridge is removable from the vaporizer, the atomizer, for example atomizer 33, and heating element are easily accessible through a bottom of the cartridge. Additionally, each cartridge may have an identification system, for example cartridge identifier 23, which communicates with the circuit board 17 to provide information such as the cartridge type and temperature information. Examples of a suitable identification system, for example cartridge identifier 23, include bar codes, quick response codes, physical tabs, radio frequency identifiers, microchips, digital level information, etc. In one embodiment, the identification system between the cartridge and the battery unit is via a digital level such as a short to a positive circuit reference voltage line (or ground), or open (with pullup/pulldown resistors) on a cartridge ID pins to identify the cartridge type. Circuit board 17 may interface with cartridge identifier 23 to recognize a cartridge type of the cartridge, for example through an identifier reader 25, see FIG. 9, configured to read cartridge identifier 23 and transmit information about cartridge identifier 23 to circuit board 17. Circuit board 17 may use the received information about cartridge identifier 23 to determine the cartridge type. While circuit board 17 and identifier reader 25 as described in this disclosure embody an implementation of a cartridge identification sensor, given the benefit of this disclosure those skilled in the art may recognize other implementations of a cartridge identification sensor.

Figure 7:
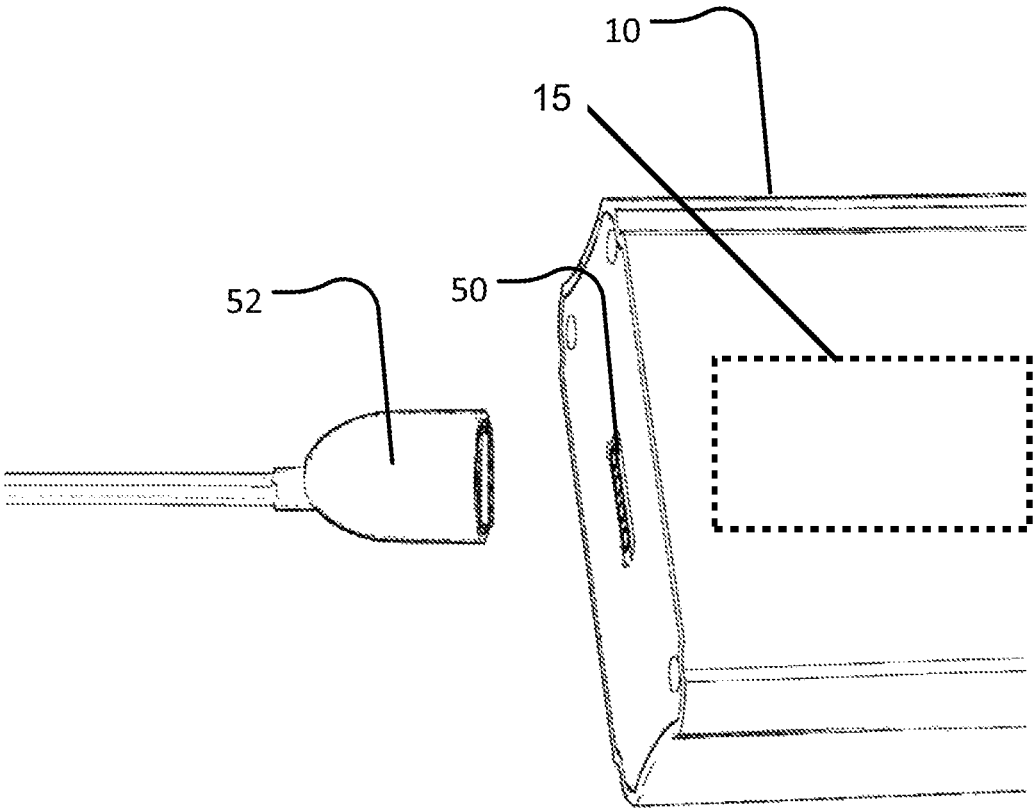
FIG. 7 illustrates a charging port of a vaporizer.

FIG. 7 illustrates a port 50 for charging the battery 15 contained within vaporizer 10. The battery 15 provides a voltage to the cartridges to actuate the atomizer, for example atomizer 33. Port 50 may be a universal serial bus (USB) port and may function to send and receive data in addition to charging the battery 15. A power cable 52 is selectively coupled to the port 50 and may be secured through a standard friction fit, a latch, or a magnetic connection.

Figure 8:
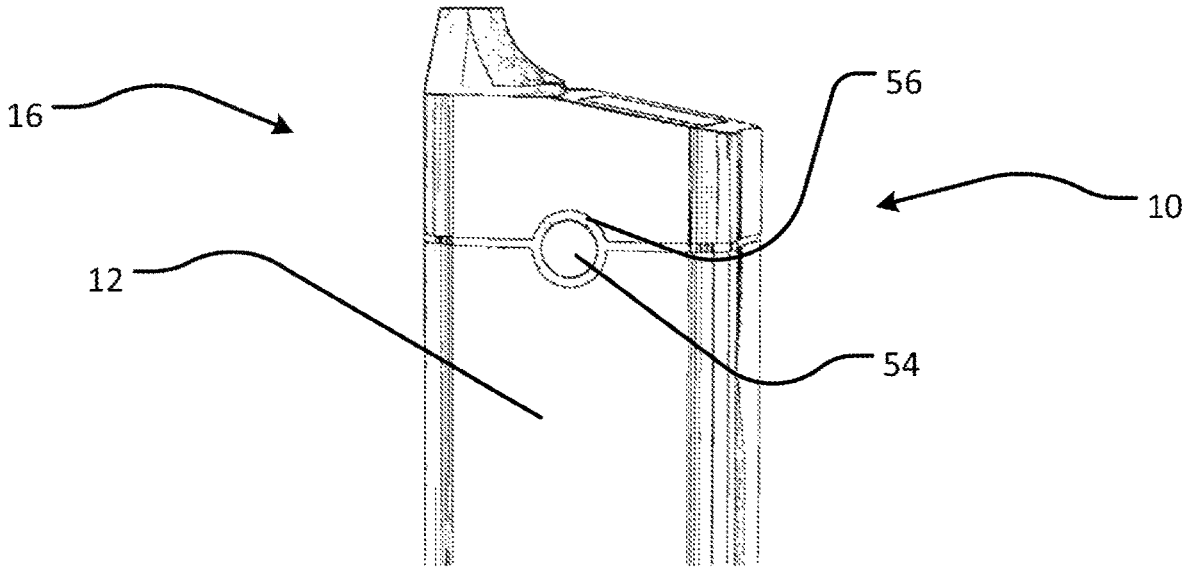
FIG. 8 illustrates an upper end of a vaporizer.
Figure 9:
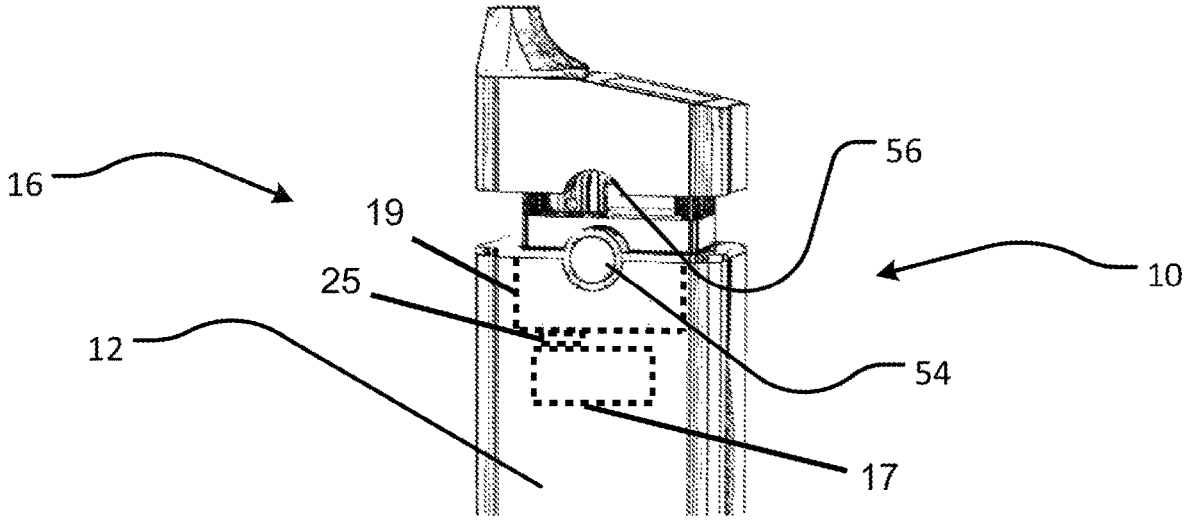
FIG. 9 illustrates an upper end of vaporizer with a cartridge ejected.

FIG. 8 illustrates the upper end 16 of vaporizer 10 showing a cartridge secured in body 12. FIG. 9 illustrates upper end 16 of vaporizer 10 showing the cartridge being ejected from body 12. The cartridge may be ejected by pressing a cartridge release button 54. Once ejected, the cartridge may be pulled from the chamber 19 of the body 12. In some embodiments, cartridge release button 54 may be locked depending on the status of the vaporizer 10. For instance, in some embodiments, ejection of the cartridge may only be possible when the user interface 18 is on. While cartridge release button 54 as described in this disclosure embodies an implementation of an interface for selectively releasing a cartridge from a chamber, given the benefit of this disclosure those skilled in the art may recognize other implementations of an interface for selectively releasing a cartridge from a chamber.

The cartridge may be inserted into body 12 by aligning a detail on body 12, such as a circular cutout 56 with the cartridge release button 54 and sliding the cartridge into place. Vaporizer 10 may provide a tactile feedback such as a "click" when the cartridge is securely in place. In some embodiments, the cartridge cannot be loaded unless vaporizer 10 is unlocked. For example, it may be necessary to press side button 32 three time in rapid succession before body 12 will accept a new cartridge.

After the cartridge is inserted, vaporizer 10 recognizes the type of cartridge and may adjust parameters as necessary. A user may unlock user interface 18 and further adjust settings if desired. In some instances, a cartridge may not be recognized, in which case a user may be required to manually enter the parameters for the particular cartridge.

Once a cartridge is loaded and the parameters are set, vaporizer 10 may be activated. In some embodiments, user interface 18 may lock automatically when vaporizer 10 is active. In such embodiments, user interface 18 may be unlocked by pressing the display for a set amount of time. Once vaporizer 10 is active, a user may activate the atomizer, for example atomizer 33, to produce vapor by pressing side button 32. Vapor is then produced and delivered to mouthpiece 46.

Figure 10:
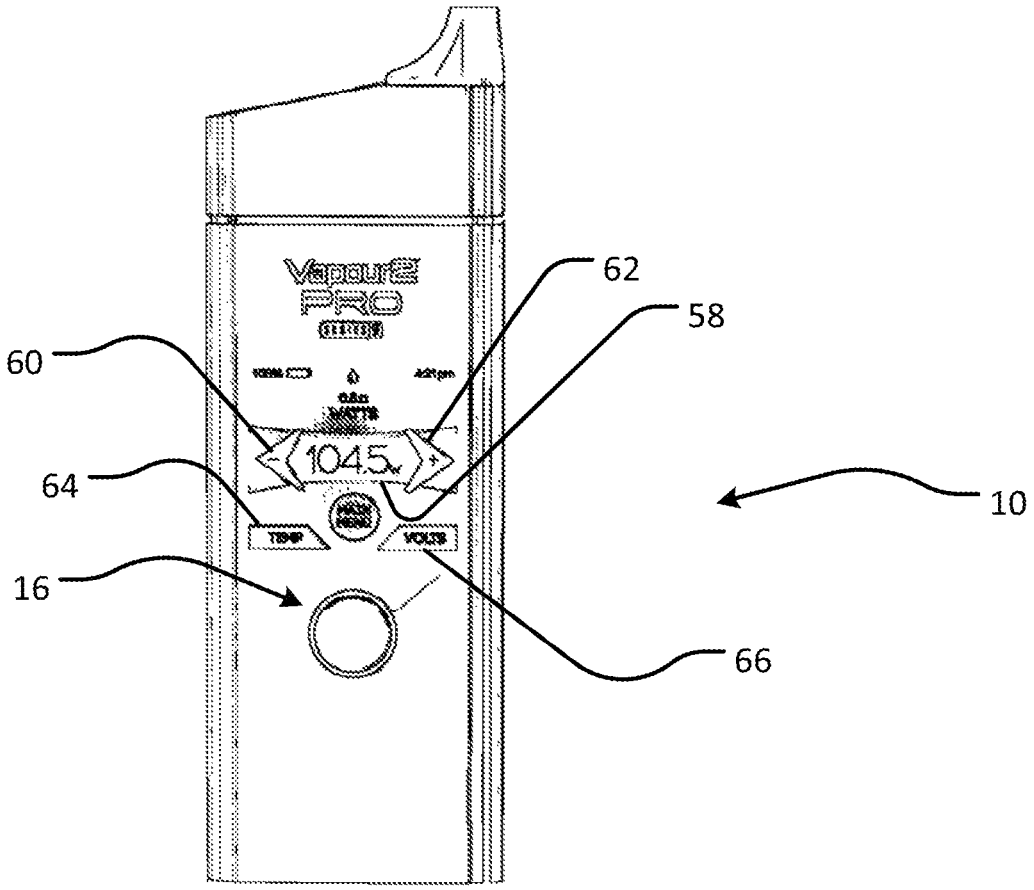
FIG. 10 illustrates a user interface of a vaporizer.

FIG. 10 illustrates user interface 18 in the form of a LCD touch screen. The user interface 18 is displaying the watts 58 delivered to the cartridge and includes a +62 and −60 for adjusting the wattage. Similarly, the temperature and volts may be adjusted by selecting the temperature button 64 or the voltage button 66. For example, for an E-liquid or essential oil type cartridge, the wattage, voltage or temperature may be adjusted to vary the amount of vapor produced. Or also, if a user has a specific heating module installed in a cartridge, the user may select for the atomizer, for example atomizer 33, to keep a consistent temperature on heating element to vaporize the ingredient. For a loose leaf cartridge, a user may input different vaporization temperatures for different medium.

As shown in FIG. 3, FIG. 4, and FIG. 5, the vaporizer is able to load different cartridges to vaporize different types of ingredients.

A liquid cartridge 38, such as the one illustrated in FIG. 4 contains an atomizer 33 suitable for vaporizing liquids. To prevent accidental or undesired activation, vaporizer 10 may cut-off automatically if side button 32 has been pressed for an extended period of time, such as ten seconds. This behavior may be automatic, based on the vaporizer 10 recognizing the type of cartridge.

A wax cartridge 40, such as that shown in FIG. 5, contains an atomizer suitable for vaporizing wax or gel ingredients. Vaporizer 10 may automatically cut off after an extended period of time greater than the period of time for a liquid cartridge, such as thirty seconds after side button 32 has been pressed and the device is activated.

The loose leaf cartridge is capable of vaporizing loose leaf products such as tobacco and contains a suitable atomizer. Because the loose leaf is not as easily vaporized as an oil or wax, it may require a more involved procedure for producing vapor. The atomizer may need to be primed before use. In some embodiments, the atomizer may be primed by pressing and holding side button 32. For example, side button 32 may be held for two seconds to prime an internal heating element of the atomizer. As a visual feedback, ring light 21 may glow varying colors based on the device status. For instance, it may glow red, then yellow and finally, green when the vaporizer 10 is ready for use. This process may take considerably longer than the amount of time to vaporize liquids and waxes. In some embodiments it may take one hundred and fifty seconds for the process to complete. The process may be aborted by pressing and holding side button 32 during the priming.

Figure 11:
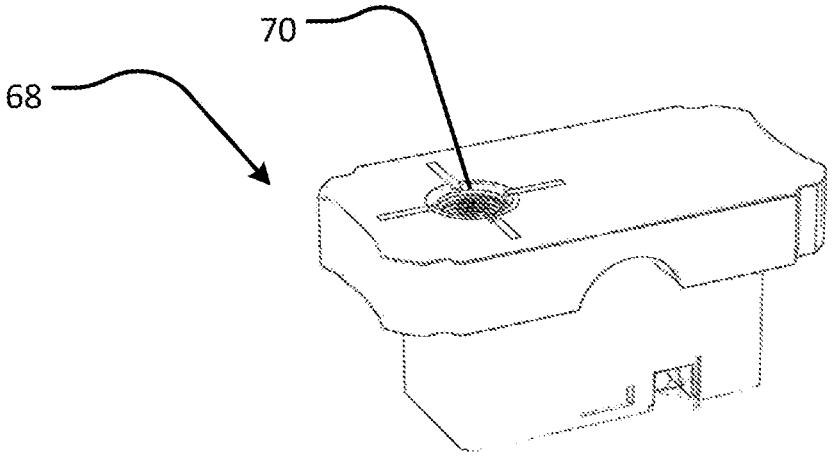
FIG. 11 illustrates a threaded adapter cartridge.

FIG. 11 illustrates a cartridge 68 suitable for connecting vaporizer 10 to a threaded accessory such as a tank. Cartridge 68 includes an atomizer and product for producing vapor. In place of a mouthpiece, the cartridge includes a threaded adapter 70. The threaded adapter 70 may receive common threaded accessories such as a tank for storing vapor.

The descriptions set forth above are meant to be illustrative and not limiting. Various modifications of the invention, in addition to those described herein, will be apparent to those skilled in the art from the foregoing description. Such modifications are also intended to fall within the scope of the concepts described herein. The disclosures of each patent, patent application and publication cited or described in this document are hereby incorporated herein by reference, in their entireties.

The foregoing description of possible implementations consistent with the present disclosure does not represent a comprehensive list of all such implementations or all variations of the implementations described. The description of some implementation should not be construed as an intent to exclude other implementations. For example, artisans will understand how to implement the invention in many other ways, using equivalents and alternatives that do not depart from the scope of the invention. Moreover, unless indicated to the contrary in the preceding description, none of the components described in the implementations are essential to the invention. It is thus intended that the embodiments disclosed in the specification be considered as illustrative, with a true scope and spirit of the invention being indicated by the following claims.

The invention claimed is:

1. A vaporizer comprising:

a body having a first end, a second end, and a longitudinal axis extending therebetween, the body including:
- a chamber in an upper end of the body,
- a battery,
- a control panel,
- at least one opening in fluid communication with an environment external to the body, and
- an interface at the upper end of the body;

a repositionable structure coupled to the body and configured to slide relative to and along the longitudinal axis of the body to selectively cover and uncover the at least one opening; and a cartridge having a base portion that is sized and shaped to complement the chamber, the cartridge having a vaporizable product container and an atomizer, wherein when the cartridge is received in the chamber, the atomizer is in fluid communication with the at least one opening;

wherein the interface is configured to selectively engage the cartridge when the cartridge is received within the chamber to secure the cartridge to the chamber and allow the cartridge to be subsequently released and removed from the chamber.

2. The vaporizer of claim 1, wherein the at least one opening comprises a plurality of holes.

3. The vaporizer of claim 1, wherein the at least one opening comprises a channel.

4. The vaporizer of claim 1, wherein the repositionable structure is configured to slide from a first position completely covering the at least one opening to a second position at least partially covering the at least one opening.

5. The vaporizer of claim 4, wherein the repositionable structure comprises a sliding switch.

6. The vaporizer of claim 1, wherein the body includes a side button that is configured to activate the atomizer of the cartridge.

7. The vaporizer of claim 1, wherein the body includes a side button that is configured to selectively lock and unlock the body.

8. The vaporizer of claim 7, wherein, when the body is unlocked, the cartridge can be received within the chamber.

9. The vaporizer of claim 1, wherein the control panel comprises a liquid crystal display.

10. The vaporizer of claim 1, wherein the interface comprises a cartridge release button.

11. The vaporizer of claim 1, wherein the cartridge has a circular cutout that is configured to align with the interface of the body when the cartridge is received within the chamber.

12. The vaporizer of claim 1, wherein the cartridge comprises a window that is configured to allow a user to view a production of vapor within the cartridge.

* * * * *